US009649523B2

(12) United States Patent
Brady

(10) Patent No.: US 9,649,523 B2
(45) Date of Patent: May 16, 2017

(54) EXERCISE CHAIR

(71) Applicant: Tom Brady, Madison, CT (US)

(72) Inventor: Tom Brady, Madison, CT (US)

( * ) Notice: Subject to any disclaimer, the term of this patent is extended or adjusted under 35 U.S.C. 154(b) by 0 days.

(21) Appl. No.: 15/090,012

(22) Filed: Apr. 4, 2016

(65) Prior Publication Data

US 2016/0287968 A1 Oct. 6, 2016

Related U.S. Application Data

(60) Provisional application No. 62/141,893, filed on Apr. 2, 2015.

(51) Int. Cl.

| | |
|---|---|
| ***A63B 26/00*** | (2006.01) |
| ***A63B 22/00*** | (2006.01) |
| ***A61H 3/00*** | (2006.01) |
| ***A47D 13/04*** | (2006.01) |
| ***A63B 21/068*** | (2006.01) |
| ***A63B 21/00*** | (2006.01) |
| ***A47C 3/20*** | (2006.01) |
| ***A47C 9/00*** | (2006.01) |
| *A63B 23/04* | (2006.01) |

(52) U.S. Cl.

CPC ..... *A63B 21/068* (2013.01); *A47C 3/20* (2013.01); *A47C 9/002* (2013.01); *A63B 21/00047* (2013.01); *A63B 23/04* (2013.01); *A63B 21/00069* (2013.01); *A63B 21/4035* (2015.10); *A63B 23/0405* (2013.01); *A63B 2022/0094* (2013.01); *A63B 2208/0233* (2013.01); *A63B 2210/50* (2013.01); *A63B 2225/09* (2013.01); *A63B 2225/093* (2013.01)

(58) Field of Classification Search

CPC . A63B 21/068; A63B 23/04; A63B 21/00047; A63B 21/4035; A63B 23/0405; A63B 2022/0094; A63B 2208/0233; A63B 2225/093; A63B 2225/09; A63B 2210/50; A63B 21/00069; A47C 3/20; A47C 9/002

USPC ..... 482/51, 66, 92, 121–124, 129–130, 142

See application file for complete search history.

(56) References Cited

U.S. PATENT DOCUMENTS

| | | | | | |
|---|---|---|---|---|---|
| 781,683 | A * | 2/1905 | Shepherd | A63B 21/0552 | 482/129 |
| 1,475,442 | A * | 11/1923 | Manger | A47D 13/043 | 297/174 R |
| 2,109,188 | A * | 2/1938 | Elizaveta | A63B 69/0064 | 182/7 |
| 2,282,689 | A * | 5/1942 | Butler | A61H 3/04 | 135/67 |
| 3,778,052 | A * | 12/1973 | Andow | A61H 3/008 | 135/67 |

(Continued)

*Primary Examiner* — Stephen Crow
*Assistant Examiner* — Garrett Atkinson
(74) *Attorney, Agent, or Firm* — Tom Brady

(57) ABSTRACT

An exercise chair is disclosed having an adjustable height that functions to exercise the lower body by progressively lowering the height of the seat. By lowering the height of the seat, the user will increase the amount of muscle activation and therefore facilitate lower extremity strengthening. The seat of the exercise chair can be adjusted between 24 inch maximum height to 12 inch minimum height from the floor. The chair may be used as a therapy chair by a therapy professional or by an individual who wants to exercise his or her lower extremities or to facilitate standing by a seated individual.

7 Claims, 9 Drawing Sheets

(56) References Cited

U.S. PATENT DOCUMENTS 3,993,349 A * 11/1976 Neufeld ..... A61H 3/00 135/67
4,025,083 A * 5/1977 Saint ..... A47D 13/043 248/439
4,239,135 A * 12/1980 Armstrong ..... E04H 15/30 224/154
4,474,202 A * 10/1984 Blechner ..... A61H 3/00 135/67
4,796,903 A * 1/1989 Proctor ..... A61H 3/04 280/32.5
4,833,730 A * 5/1989 Nelson ..... A61F 5/028 2/44
4,907,839 A 3/1990 Rose et al.
4,941,497 A * 7/1990 Prather ..... A61H 3/008 135/67
4,974,620 A * 12/1990 Quillan ..... A61H 3/00 108/25
5,050,862 A * 9/1991 Saghafi ..... A47D 13/043 280/87.051
5,221,241 A * 6/1993 Bare, II ..... A63B 69/0064 482/124
5,234,394 A * 8/1993 Wilkinson ..... A63B 21/055 482/121
5,255,697 A * 10/1993 Grauer ..... A61H 3/04 135/67
5,380,262 A * 1/1995 Austin ..... A61H 3/04 280/647
5,577,984 A * 11/1996 Bare, II ..... A63B 21/16 482/123
5,655,235 A * 8/1997 DeAth ..... A45F 3/26 5/121
5,704,682 A * 1/1998 Gorayeb ..... A47C 9/10 297/440.11
5,800,317 A * 9/1998 Accetta ..... A61H 3/04 135/67
5,800,318 A * 9/1998 Coviello ..... A61H 3/04 135/67
5,862,825 A * 1/1999 Leonard ..... A61H 3/00 135/67
5,921,900 A * 7/1999 Mankovitz ..... A63B 23/03516 482/121
6,267,711 B1 * 7/2001 Hinds ..... A63B 1/00 482/121
6,413,249 B1 * 7/2002 Turi ..... A61F 13/49019 604/385.21
6,578,594 B1 * 6/2003 Bowen ..... A61H 3/008 135/67
7,001,313 B1 * 2/2006 Crnkovich ..... A61H 3/04 135/67
7,537,553 B2 * 5/2009 Mongelluzzo ..... A47C 9/002 482/121
7,699,762 B2 * 4/2010 Turnbull ..... A63B 21/04 482/130
7,926,834 B2 * 4/2011 Willis ..... A61G 5/08 135/67
2001/0027149 A1 * 10/2001 Bingham ..... A47D 13/046 482/69
2005/0211285 A1 * 9/2005 Cowie ..... A45B 7/00 135/74
2005/0257819 A1 * 11/2005 Willis ..... A61H 3/04 135/74
2007/0173380 A1 7/2007 Gabel et al.
2009/0152826 A1 * 6/2009 Silva ..... B62B 5/002 280/47.34
2011/0083266 A1 4/2011 Herron
2011/0260421 A1 * 10/2011 Willis ..... A61H 3/04 280/87.041
2012/0202656 A1 * 8/2012 Dorsay ..... A63B 23/1209 482/121
2013/0157818 A1 * 6/2013 Lalaoua ..... A63B 71/023 482/123
2016/0106617 A1 * 4/2016 Wobith ..... A61H 3/04 280/643

* cited by examiner

Front view

Top view

Side view

Detail side view of hinge A

EXERCISE CHAIR

This application claims priority based on Provisional Application Ser. No. 62/141,893 filed Apr. 2, 2015.

TECHNICAL FIELD

The present invention relates to chairs used for seating a person to facilitate exercise supervised by therapists or exercise professionals or for individuals who exercise on their own, and more particularly to a foldable and adjustable chair for use by exercise professionals or by a broad range of individuals who want to exercise their lower extremities so as to strengthen the same.

BACKGROUND OF THE INVENTION

In today's world, time and freedom to carry out tasks as intended is of the essence. Exercise and/or physical therapy treatments are expected to be provided in a transferable, portable, efficient and economical manner. An exercise chair for facilitating the carrying out of the same is expected to be used by multiple persons having different height needs or for one person with different or changing needs. A particular application is to strengthen the lower extremities so as to allow an individual to stand from a seated position unaided.

Such an exercise chair should be adjustable, capable of seating multiple patients at differing times and at differing heights, and moreover to enable recovering patients to exercise at progressive height positions. Further, the exercise chair should be foldable to save valuable space for storage and also to be portable for travel.

SUMMARY OF THE INVENTION

The exercise chair described herein is directed to a device that anyone, who has difficulty rising from a chair or wants to strengthen his or her lower extremities, can benefit from.

It is one object of the present invention to provide a lightweight, foldable, portable and adjustable chair on which a patient or individual may be seated at different height positions and to then exercise their lower extremities at such different height positions.

It is another object of the present invention to provide a chair having a frame, an armrest and a seat position that can be adjusted with respect to each other in order to accommodate the size of the user seated on the chair.

It is yet another object of the present invention to provide a chair, wherein the front end of the side support frame is tilted so as to provide an angle with respect to the floor so that the exercise chair is more stable.

It is still another object of the present invention to provide a chair that is foldable so that the chair can be temporally stored in a compact manner during the times it is not being used over a daily or other period.

It is still another object of the present invention to provide a chair that can be easily assembled from the separate parts thereof or broken down into the different parts forming the chair if a longer storage or travel time is needed.

In accordance with the teachings of the present invention as disclosed herein, there is provided a portable, foldable and adjustable exercise chair on which a user can be seated to facilitate movement and exercise for strengthening the lower extremities. The chair is intended to be placed on the floor for a user to exercise at different heights. The chair comprises a side frame assembly 101, rear frame assembly, seat assembly 401 and a plurality of leg support members 301, wherein the seat assembly 401 is secured to the side frame assembly 101 through a hinge and the plurality of leg support members 301 are present in a telescopic arrangement with the side frame assembly 101 in order to accommodate the different height requirements of the users.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF EXAMPLE EMBODIMENTS

Figure 1:
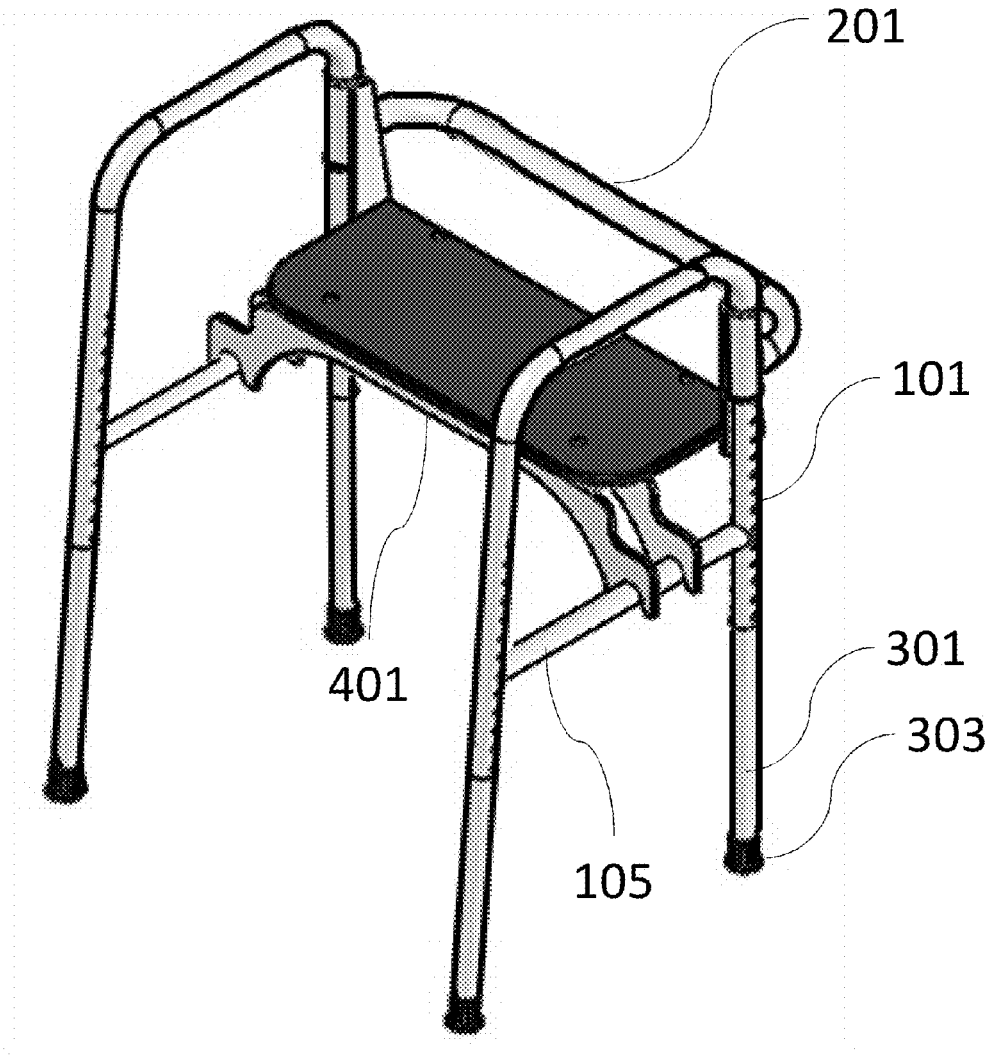
FIG. 1 is a perspective view of one embodiment of the exercise chair in accordance with the present invention.
Figure 2:
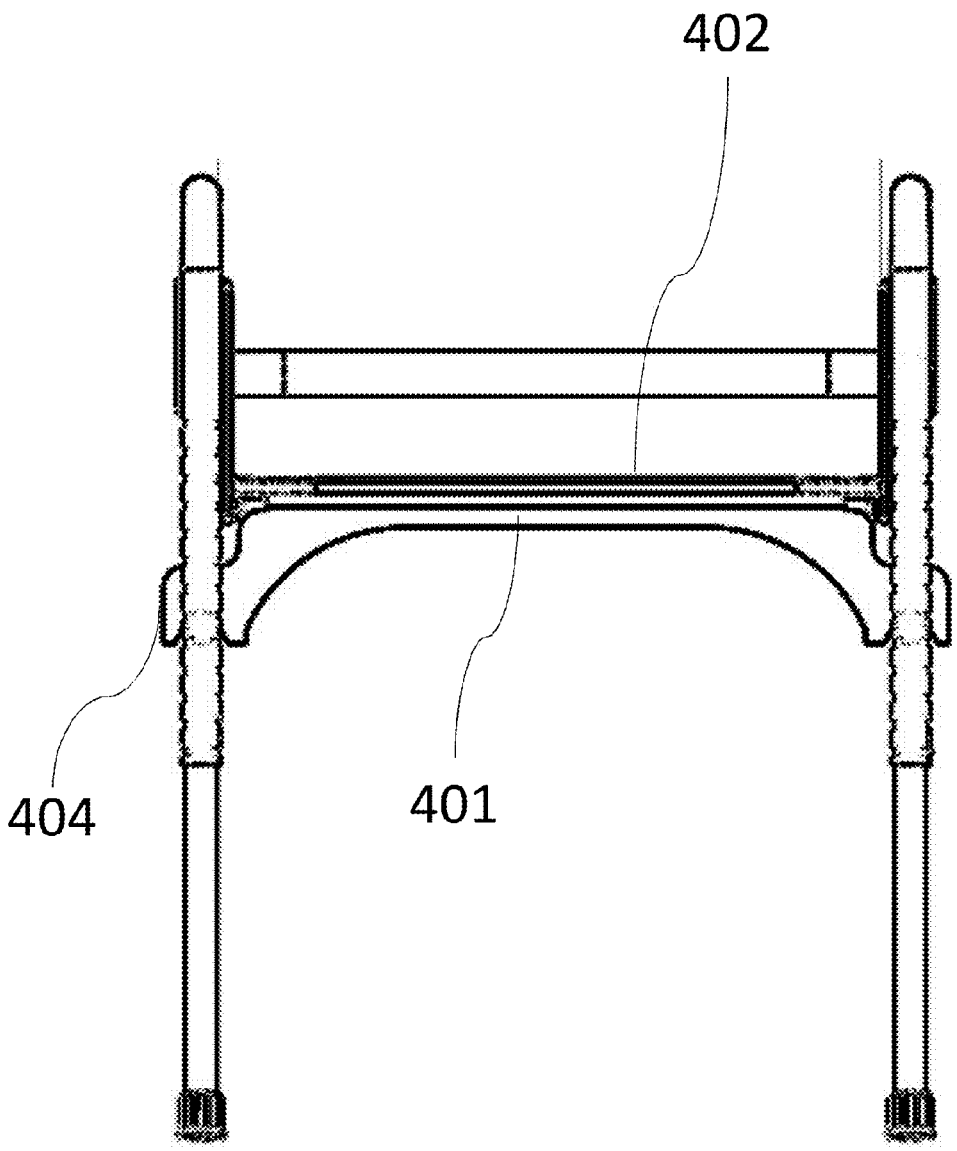
FIG. 2 is a front view of an embodiment of the exercise chair of the invention.
Figure 3:
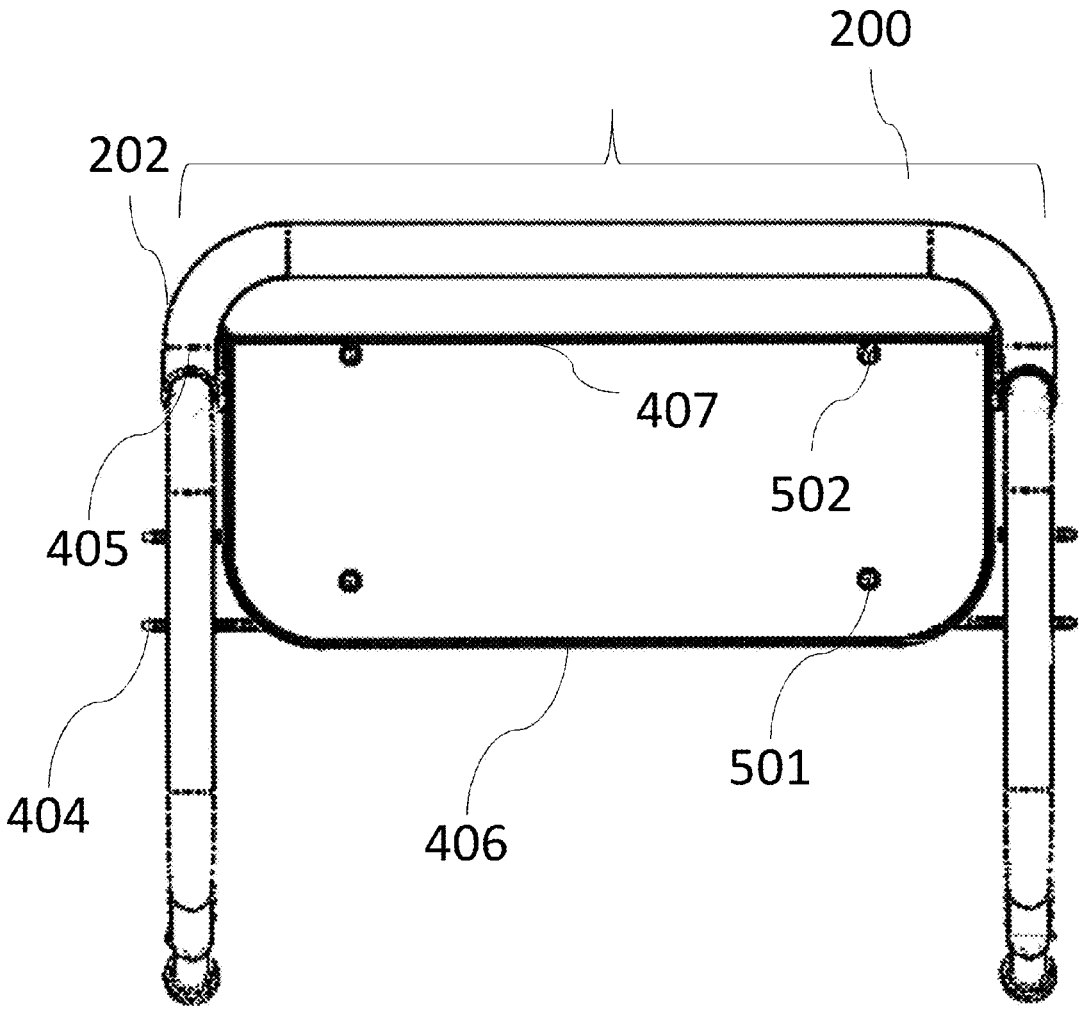
FIG. 3 is a top view of an embodiment of the exercise chair of the invention.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents that can be included within the spirit and scope of the described embodiments as defined by the appended claims.

The elements in the FIGS. are:

101 side frame assembly
102 front vertical member
103 back vertical member
104 intermediate member
105 load bearing member
106 the first curvature
107 the second curvature
109 a series of continuous holes
200 rear frame assembly
201 rear frame horizontal member
202 rear frame transition member
301 leg support
302 top end of the leg support
303 bottom end of the leg support
401 seat assembly
402 seat
403 backing member
404 engaging member
405 seat positioning bar
406 front edge of the seat
407 back edge of the seat
601 inverted U shaped side frame
701 hinge A The present invention provides a portable, foldable and adjustable chair for a user to exercise his or her lower extremities at different heights. The chair comprises a side frame assembly 101, rear frame assembly 200, leg support members 301, and a seat assembly 401. The exercise chair can be disassembled to make it portable for transportation or to provide a compact form for long-term storage of the chair. The exercise chair can be foldable as the seat assembly 401 is connected to the side frame assembly 101 through a hinge, so as to make space for temporary storage between everyday usages. The exercise chair can be adjustable by changing the relative position of the leg support members 301 and side frame assembly 101, to accommodate different heights for different users, or to allow one user to exercise at different heights.

The chair, disclosed herein, comprises a side frame assembly 101, consisting essentially of a pair of inverted U-shaped side frames 601, arranged cross-wise from each other. Each inverted U-shaped side frame 601 has a front vertical member 102, a back vertical member 103, and an intermediate member 104, wherein the back vertical member 103 is connected to the front vertical member 102 through the intermediate member 104 and the intermediate member 104 is configured to function as an armrest or a handle to be used by the user. Further the front vertical member 102 is connected to the intermediate member 104 through a first curvature 106, and the back vertical member 103 is connected to a lateral intermediate member 104 through a second curvature 107. As shown in FIGS. 1-9, the side frame comprises a single integral frame. The front and back vertical members 102 and 103 are not parallel to each other. The first curvature 106 between the front vertical member 102 and intermediate member 104, and the second curvature 107 between the intermediate member 104 and the back vertical member 103 differ from each other, with the radius of the second curvature 107 being smaller than that of the first curvature 106.

The side frame assembly 101, further comprises a load bearing member 105, arranged across between the front and back vertical members 102 and 103 of each side frame 601 and its equivalent. Each load bearing member 105 is substantially parallel to the surface on which the chair is, or is to be, disposed.

The chair, as disclosed herein, further comprises a rear frame assembly 200. In one embodiment, the rear frame assembly 200 comprises a horizontal member 201, connected to the back vertical member 103 of the side frame assembly 101 and having two transitional members 202 in between. The rear frame assembly is configured to provide back support for the user. As shown in FIGS. 1-4, the rear frame assembly is substantially parallel to the surface that the chair is, or is to be, disposed on.

The chair, disclosed herein, further comprises two pairs of leg support members 301 and their equivalents. The leg support members 301 and their equivalents join the front and back vertical members 102 and 103 of the side frame assembly 101 through a slide and click mechanism and are configured to provide ground support for the chair. Referring to FIGS. 1-9, in one embodiment, the front and back vertical members 102 and 103 are tubular frames having hollow centers to allow the leg support members 301 and their equivalents to be inserted inside the vertical members 102 and 103 in a telescopic manner. Each leg support member 301 has a top end 302 and a bottom end 303, wherein the bottom end 303 has further features for increasing the stability of the chair with respect to the surface that the chair is placed on. Near the top end thereof, each leg support member 301 bears a conventional push pin structure. Along the length of the front and back vertical members 102 and 103, a series of about 12 to about 15 continuous holes 109 are disposed. The vertical members together with the continuous holes 109 thereof allow the push pin of the leg support members 301 or its equivalents to be locked in different positions, The push pin can removably engage and lock in one of the positions on the front and back vertical members 102 and 103 to provide an adjustable height. In one example of the preset invention, there are about 15 continuous holes on each of the vertical members, and each hole is spaced one inch apart from the other. By changing the relative position between the leg support members 301 and its equivalents and front/back vertical members 102 and 103 on each side, the seat 402 of the chair can be adjusted from a 24-inch maximum height to a 12-inch minimum height. The height is measured as the height or distance from the floor or a surface that the chair is placed on, to the bottom surface of the seat 402.

The chair further comprises a seat assembly 401, comprising a seat 402, a backing member 403, a plurality of engaging members 404 or its equivalents and a seat positioning bar 405. The seat 402 has a front edge 406 and back edge 407. The bottom surface nearest to the front edge 406 of the seat 402 is secured to the backing member 403 through a pair of permanent nuts 501. The bottom surface nearest to the back edge 407 of the seat 402 is secured to the seat positioning bar 405 through a pair of permanent nuts 502.

The backing member 403, engaging members 404 and seat positioning bar 405 work together to form a seat positioning system, which releasably attach to the seat 402 in either an erected or collapsible position. The backing member 403 is adhered to a bottom surface of the seat 402 through a pair of permanent nuts 501. The plurality of engaging members 404 are attached to corners of the backing member 403, configured to releasably engage the load bearing member 105 of the side frame assembly 101, such that when the load bearing member 105 and the engaging members 404 of the seat assembly 401 are engaged, the seat 402 is secured in a desired use position.

The seat positioning bar 405 is oriented parallel to the horizontal member in the rear frame assembly 201 and hingedly attached to the respective left and right back vertical members 103 and equivalent, in a position above the load bearing member 105 but below the horizontal member 201 in the rear frame assembly.

Figure 4:
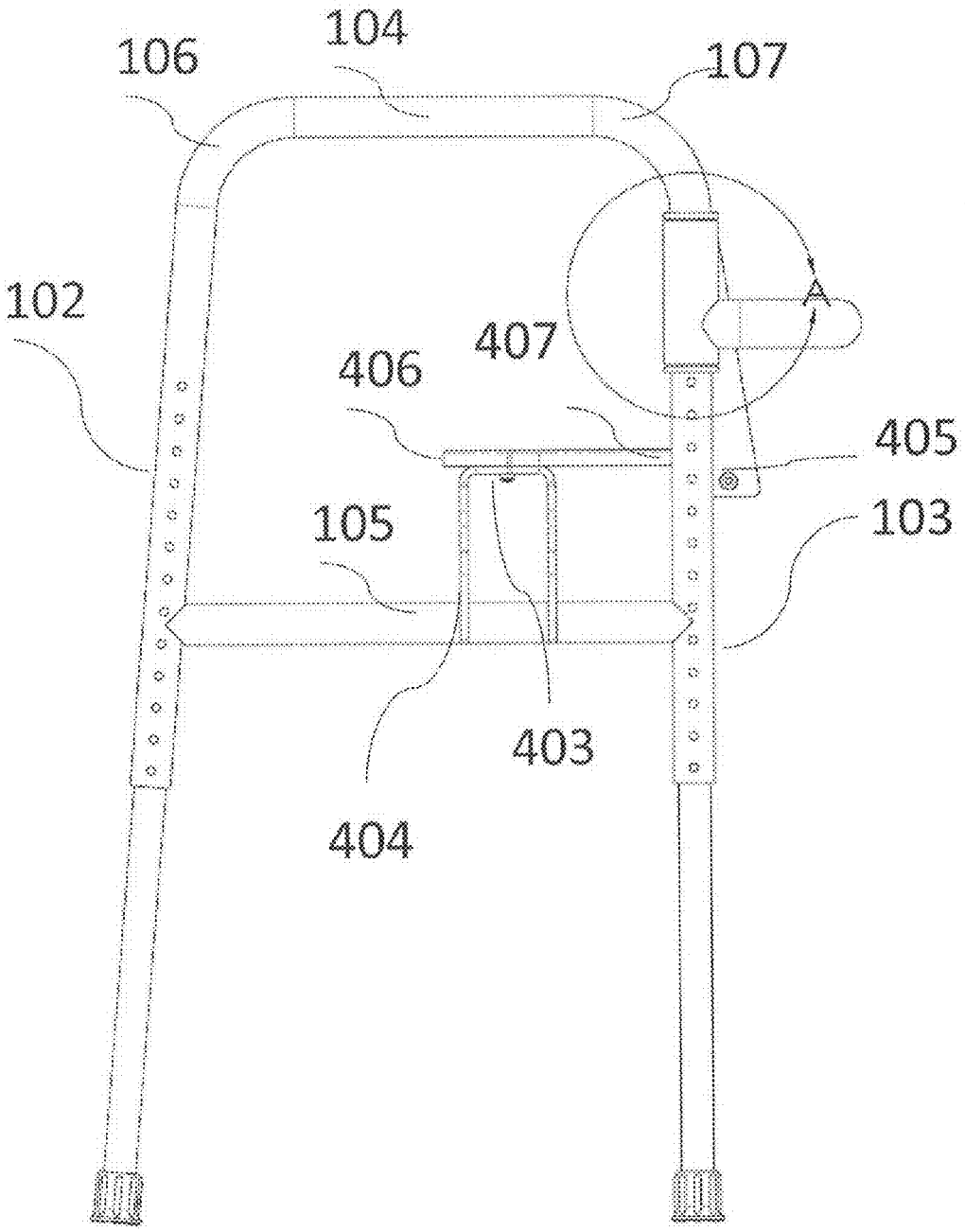
FIG. 4 is a side view of an embodiment of the exercise chair of the invention.
Figure 5:
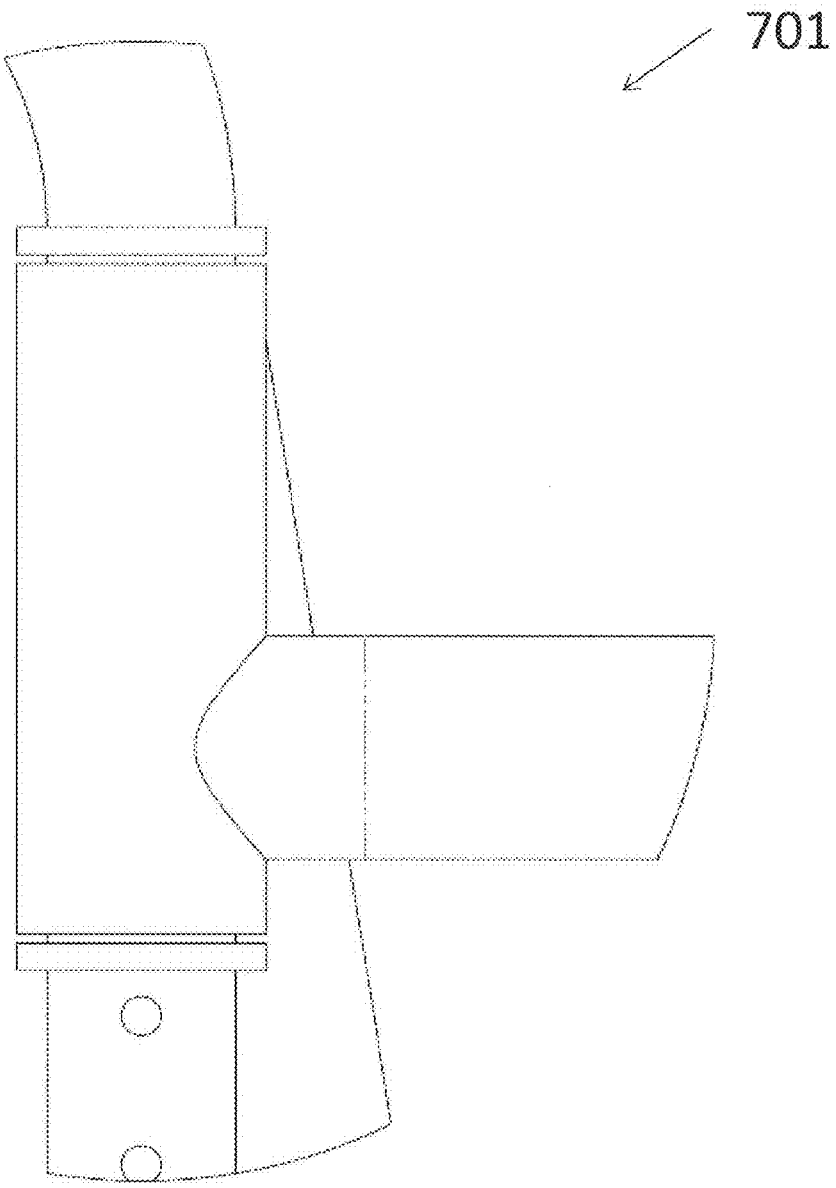
FIG. 5 is a side view of hinge A in FIG. 4 shown in detail.
Figure 6:
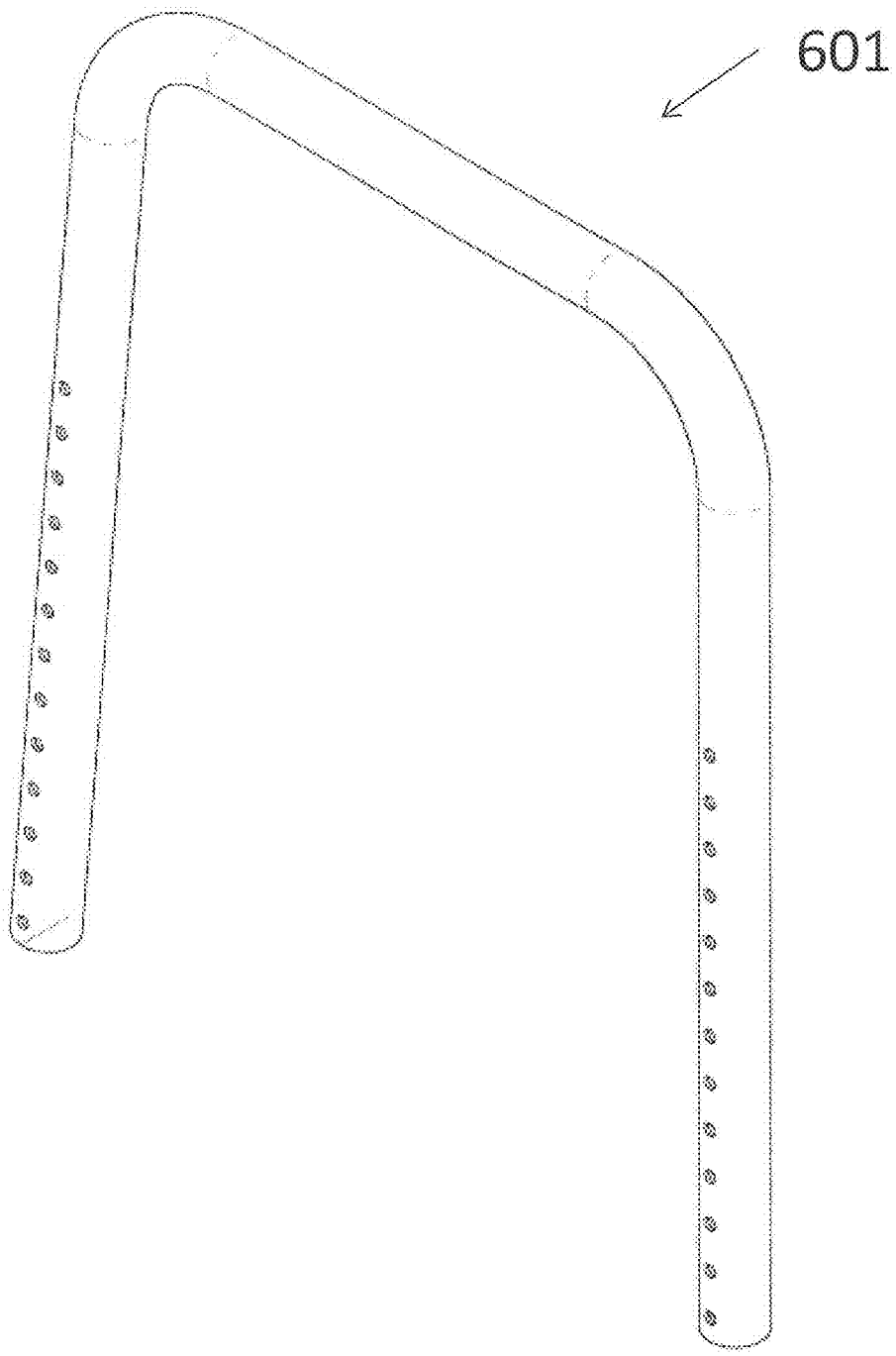
FIG. 6 is a perspective view of an exemplar side frame 601.
Figure 7:
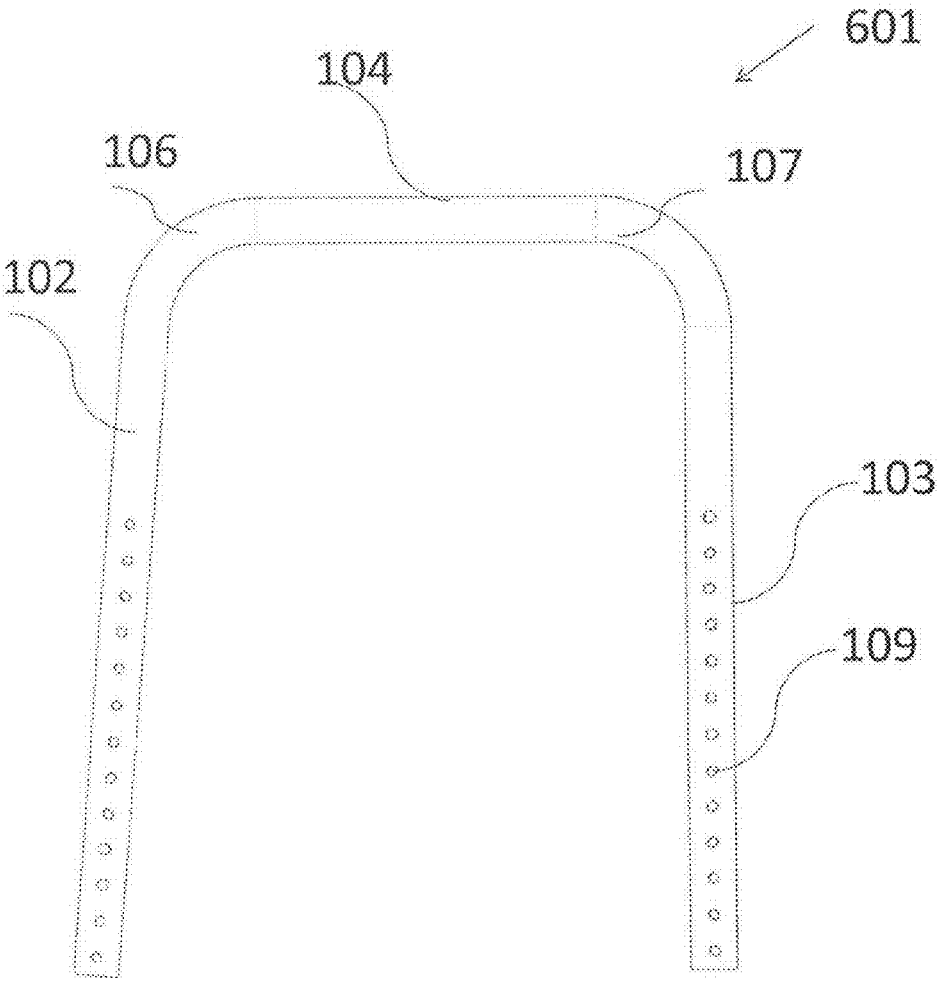
FIG. 7 is a front view of the exemplar side frame of FIG. 6.
Figure 8:
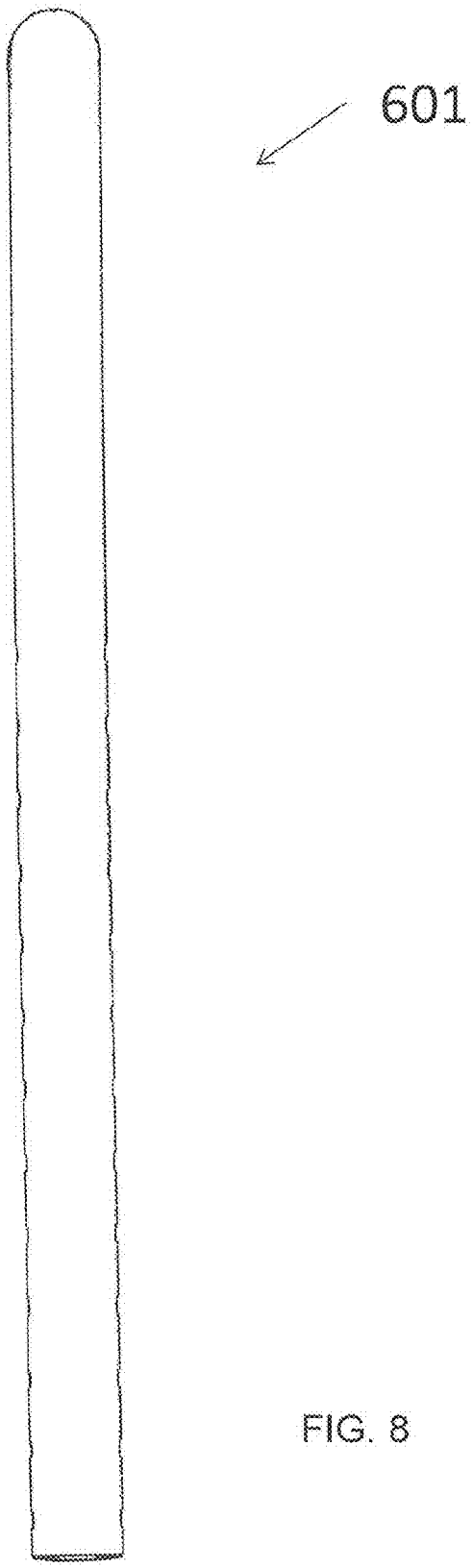
FIG. 8 is a side view of the exemplar side frame of FIG. 6.
Figure 9:
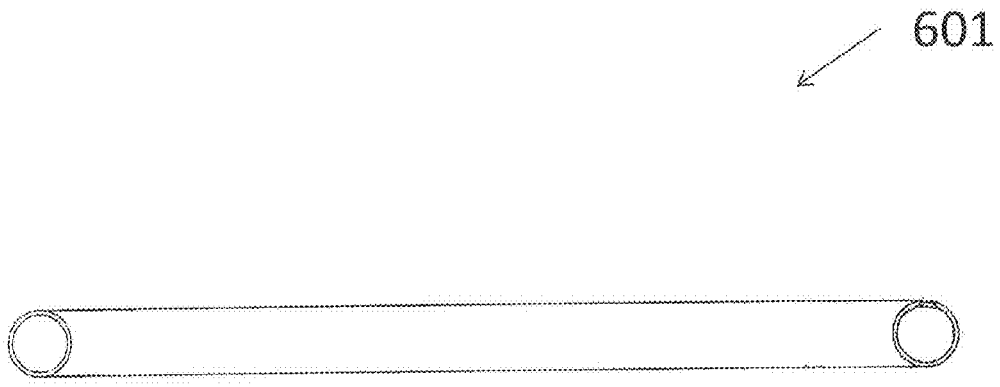
FIG. 9 is a top view of the exemplar side frame of FIG. 6.

Referring to FIGS. 4 and 5, the seat positioning bar 405 is connected to the left and right back vertical members 103 of the side frame assemblies through a hinge A (701). The hinge A (701) allows the seat positioning bar 405 to move in and out of the plane or rotate.

When the load bearing member 105 and the engaging members (eg. 404) of the seat assembly 401 are disengaged, the seat 402 may be turned into a folded position. Between the engaged and disengaged position of the seating assembly and the load bearing member 105, the chair may be adjusted between a fully erected and a fully collapsed position.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not meant to be exhaustive or to limit the embodiments to the precise forms disclosed.

It will be apparent to one of ordinary skill in the art that many modifications and variations are possible in view of the above teachings.

The advantages of the embodiments described are numerous. Different aspects, embodiments or implementations can yield one or more of the following advantages, including portability, adjustability to different heights, lightweight, stability, easy disassembly and assembly, etc. Many features and advantages of the present embodiments are apparent from the written description and, thus, it is intended by the appended claims to cover all such features and advantages of the invention. Further, since numerous modifications and changes will readily occur to those skilled in the art, the embodiments should not be limited to the exact construction and operation as illustrated and described. Hence, all suitable modifications and equivalents can be resorted to as falling within the scope of the invention

The invention claimed is:

1. A chair to be placed on a floor for a user to exercise at different heights of said chair, comprising:

a side frame assembly, comprised of a pair of inverted U-shaped tubular side frames, arranged cross-wise from each other, each having a tubular front vertical member and a tubular back vertical member, connected through a tubular intermediate member, the intermediate member configured to function as an armrest or handle for the user, wherein the front vertical member, back vertical member and the intermediate member integrally form an inverted U-shape; and a load bearing member, arranged between the front and back vertical members of each side frame and substantially parallel to the floor;

a rear frame assembly, comprising a horizontal member and two transition members, connected to the back vertical members of the side frame assembly, configured to provide back support for the user;

a plurality of leg support members, joined with the front and a back vertical members of the side frame assembly through a slide and lock mechanism, configured to provide ground support for the chair;

a seat assembly, comprising a seat, having a front edge and back edge, a backing member, adhered to a bottom surface near the front edge of the seat through a pair of permanent nuts;

four engaging members, attached to corners of the backing member, configured to releasably engage the load bearing member of the side frame assembly; and a seat positioning bar oriented parallel to the horizontal member of the rear frame assembly and hingedly attached to the two back vertical members, in a position above the load bearing member but below the transition member in the rear frame assembly, the seat being secured to the seat positioning bar through a pair of nuts located near the back edge of the seat;

a hinge located between the seat positioning bar and the side frame assembly allowing the seat to be in a collapsed position when the engaging member is disengaged from the load bearing member.

2. The chair of claim 1, wherein there are two pairs of said leg support members which are inserted into the tubes of the front and back vertical members, and near the top of each leg support member, a push pin is provided.

3. The chair of claim 2, wherein between the middle to lower portion of the tubular front and back vertical members, holes are disposed at regular intervals, configured to lock the push pin of each leg support member in place.

4. The chair of claim 1, wherein the side frame and leg support members can be locked at about 12 to about 15 positions along the length of the front and back vertical members.

5. The chair of claim 4, wherein the chair seat can be adjusted to between an about 12-inch height to an about 24-inch height from the floor.

6. The chair of claim 4 wherein said positions are spaced about 1 inch from each other.

7. The chair of claim 1, wherein the front vertical member and the back vertical member are not parallel to each other.

* * * * *